US008556995B2

(12) United States Patent
Haerri et al.

(10) Patent No.: US 8,556,995 B2
(45) Date of Patent: Oct. 15, 2013

(54) DYEING AUXILIARY

(75) Inventors: Hans Peter Haerri, Ettingen (CH); Franz Gruener, Schopfheim (DE); Edvard Ham, Riehen (CH); Huiya Yuan, Guangzhou (CN); Xiaolong Lu, Zhongshan (CN)

(73) Assignee: Huntsman International LLC, The Woodlands, TX (US)

( * ) Notice: Subject to any disclaimer, the term of this patent is extended or adjusted under 35 U.S.C. 154(b) by 0 days.

(21) Appl. No.: 13/395,546

(22) PCT Filed: Sep. 6, 2010

(86) PCT No.: PCT/CN2010/001345

§ 371 (c)(1),
(2), (4) Date: Mar. 12, 2012

(87) PCT Pub. No.: WO2011/035533

PCT Pub. Date: Mar. 31, 2011

(65) Prior Publication Data

US 2012/0167315 A1 Jul. 5, 2012

(30) Foreign Application Priority Data

Sep. 28, 2009 (EP) ..... 09171431

(51) Int. Cl.

| | |
|---|---|
| ***D06P 1/38*** | (2006.01) |
| ***D06P 1/39*** | (2006.01) |
| ***D06P 3/24*** | (2006.01) |
| ***D06P 3/60*** | (2006.01) |
| ***D06P 3/66*** | (2006.01) |
| ***D06P 3/82*** | (2006.01) |
| ***D06P 3/85*** | (2006.01) |
| ***D06P 3/852*** | (2006.01) |

(52) U.S. Cl.
USPC ..... 8/529; 8/531; 8/685; 8/674; 8/917; 8/926; 8/924; 8/543

(58) Field of Classification Search
USPC ..... 8/580, 606, 611, 594, 916, 920, 924, 8/529, 531, 685, 674, 917, 926, 543
See application file for complete search history.

(56) References Cited

U.S. PATENT DOCUMENTS 5,711,899 A * 1/1998 Kawa et al. ..... 516/77
5,914,445 A 6/1999 Binz et al.
6,121,331 A * 9/2000 Ansmann et al. ..... 516/77
2007/0089244 A1* 4/2007 Penninger ..... 8/115.51
2008/0109968 A1* 5/2008 Gardiner et al. ..... 8/636

OTHER PUBLICATIONS

International Search Report and Written Opinion regarding corresponding application No. PCT/CN2010/001345, dated Dec. 16, 2010.

* cited by examiner

*Primary Examiner* — Lorna M Douyon
*Assistant Examiner* — Amina Khan

(57) ABSTRACT

A composition comprising (a) a betaine of formula (1)

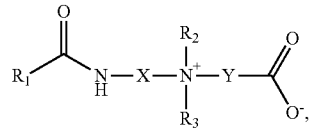

wherein $R_1$ is a monovalent radical of an aliphatic $C_4$-$C_{30}$-hydrocarbon, $R_2$ and $R_3$ independently of one another represent $C_1$-$C_{12}$alkyl and X and Y independently of one another denote a bivalent radical of an aliphatic $C_1$-$C_{12}$-hydrocarbon, (b) a quaternary ammonium salt of formula (2)

(2)

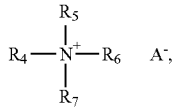

wherein $R_4$ is a monovalent radical of an aliphatic $C_4$-$C_{30}$-hydrocarbon, $R_5$, $R_6$ and $R_7$ independently of one another represent $C_1$-$C_{12}$alkyl, $C_5$-$C_{24}$aryl or $C_6$-$C_{30}$aralkyl, $A^-$ is halogenide, nitrate, hydrogensulfate or sulfonate, and (c) an alkoxylated fatty alcohol, is suitable as shade enhancer for the EL portion in PA/EL blends in the dyeing process using dark shade dyes.

4 Claims, No Drawings

DYEING AUXILIARY

CROSS REFERENCE TO RELATED APPLICATIONS

This application is the National Phase of International Application PCT/CN2010/001345 filed Sep. 6, 2010 which designated the U.S. and which claims priority to European (EP) Pat. App. No. 09171431.1 filed Sep. 28, 2009. The noted applications are incorporated herein by reference.

The present invention relates to a textile auxiliary composition comprising an amphoteric, a cationic and a non-ionic surfactant and a process for dyeing blends of polyamide and elastane fibres.

A disadvantageous effect that frequently appears during the dyeing of polyamide/elastane (PA/EL) blends is the shade difference between the PA and the EL part of the fibre blend, in particular when dark shades are dyed.

The appearance of the dyed blends can be improved by application of auxiliaries, like some specific quaternary ammonium salts, which enhance the shade depth on the elastane part, thus effectuating a certain on-tone colouration of the blend.

The use of these auxiliaries, on the other hand, is often associated with a deterioration of fastness properties, in particular wet fastness.

Moreover, addition of such shade enhancing agents to the dye liquor usually gives rise to a certain degree of precipitation.

It has now been found that the shortcomings mentioned above can be overcome by application of a textile auxiliary containing an amphoteric, a cationic and a non-ionic surfactant.

The present invention accordingly relates to a composition comprising (a) a betaine of formula

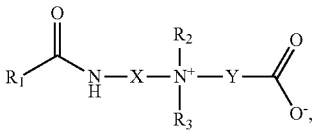

(1)

wherein $R_1$ is a monovalent radical of an aliphatic $C_4$-$C_{30}$-hydrocarbon, $R_2$ and $R_3$ independently of one another represent $C_1$-$C_{12}$ alkyl and X and Y independently of one another denote a bivalent radical of an aliphatic $C_1$-$C_{12}$-hydrocarbon, (b) a quaternary ammonium salt of formula (2)

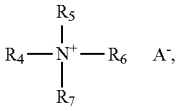

(2)

wherein $R_4$ is a monovalent radical of an aliphatic $C_4$-$C_{30}$-hydrocarbon, $R_5$, $R_6$ and $R_7$ independently of one another represent $C_1$-$C_{12}$alkyl, $C_5$-$C_{24}$aryl or $C_6$-$C_{30}$aralkyl, $A^-$ is halogenide, nitrate, hydrogensulfate or sulfonate, and (c) an alkoxylated fatty alcohol.

Betaines of formula (1) are known as amphoteric surfactants; they are commercially available or can be prepared according to known methods, for example by reaction of chlorocarboxylic acids with the corresponding amines.

$R_1$ in formula (1) appropriately is the saturated or unsaturated aliphatic radical derived from a fatty alcohol, like for example n-butyl, n-pentyl, n-decyl, n-undecyl, n-dodecyl, stearyl, eicosyl, 9-hexadecenyl, 9-octadecenyl, 11-octadecenyl or octadecatrienyl.

X and Y can be saturated or unsaturated aliphatic bivalent radicals, like methylene, ethylene, propylene, trimethylene, tetramethylene, hexamethylene, 2-butene-1,4-diyl and 2-pentene-1,5-diyl.

Example for alkyl groups as radicals $R_2$ and $R_3$ are methyl, ethyl, n-propyl, isopropyl, n-butyl, isobutyl, sec-butyl, tert-butyl, n-pentyl, neopentyl, n-hexyl, n-heptyl, n-octyl, isooctyl, n-decyl and n-dodecyl.

Preferably component (a) is a betaine of formula (1), wherein $R_1$ is n-undecyl.

X is preferably trimethylene in formula (1).

Y is preferably methylene in formula (1).

In a further preferred embodiment component (a) is a betaine of formula (1), wherein $R_2$ and $R_3$ represent methyl.

Cocoamidopropyl betaine is particularly preferred as component (a).

Quaternary ammonium salts of formula (2) are known as cationic surfactants and can be prepared according to well-known methods.

$R_4$ in formula (2) appropriately is the saturated or unsaturated aliphatic radical derived from a fatty alcohol, like for example n-butyl, n-pentyl, n-decyl, n-undecyl, n-dodecyl, stearyl, eicosyl, 9-hexadecenyl, 9-octadecenyl, 11-octadecenyl or octadecatrienyl.

Example for alkyl groups as radicals $R_5$, $R_6$ and $R_7$ are methyl, ethyl, n-propyl, isopropyl, n-butyl, isobutyl, sec-butyl, tert-butyl, n-pentyl, neopentyl, n-hexyl, n-heptyl, n-octyl, isooctyl, n-decyl and n-dodecyl.

Example for aryl groups as radicals $R_5$, $R_6$ and $R_7$ are phenyl, tolyl, mesityl, isityl, 2-hydroxyphenyl, 4-hydroxyphenyl, 2-chlorophenyl, 4-chlorophenyl, 2,6-dichlorophenyl, 2-aminophenyl, 3-aminophenyl, 4-aminophenyl, 4-methoxyphenyl, 4-ethoxyphenyl, naphthyl and phenanthryl.

Examples of suitable aralkyl groups are benzyl, 2-phenylethyl, tolylmethyl, mesitylmethyl and 4-chlorophenylmethyl.

Preferably component (b) is a quaternary ammonium salt of formula (2) wherein $R_4$ is n-dodecyl.

$R_5$ is preferably benzyl in formula (2).

$R_6$ and $R_7$ preferably represent methyl.

$A^-$ in formula (2) is preferably halogenide or sulfonate, in particular chloride.

Dodecyl dimethyl benzyl ammonium chloride is particularly preferred as component (b).

Alkoxylated fatty alcohols suitable as component (c) are known and can be prepared according to known methods, for example by reaction of a fatty alcohol with the corresponding alkylene oxide, like ethylene oxide or propylene oxide.

In a preferred embodiment component (c) is an ethoxylated or propoxylated palmitoleyl alcohol, stearyl alcohol, elaidyl alcohol, oleyl alcohol, linoleyl alcohol or linolenyl alcohol.

Particularly preferred as component (c) is ethoxylated oleyl alcohol.

In a particularly preferred embodiment the composition according to the invention contains (a) cocoamidopropyl betaine (b) dodecyl dimethyl benzyl ammonium chloride and (c) ethoxylated oleyl alcohol.

The ratio of the amounts of components (a), (b) and (c) can vary within wide limits.

Preferably the amount of component (a) is 30 to 70 parts by weight, more preferably 40 to 60 parts by weight, whereas the amount of component (b) is 15 to 40 parts by weight, more preferably 20 to 30% by weight, and the amount of component (c) is 15 to 40 parts by weight, more preferably 20 to 30% by weight.

The adjuvant composition according to the invention is usually applied as aqueous solution with a total solids content of about 5 to 50% by weight, preferably 10 to 30% by weight. In order to keep a neutral to slightly acidic pH, it is advisable to add a small amount of alkali, for instance sodium hydroxide, to the aqueous solution.

The aqueous solution containing the adjuvant composition according to the invention is a storage-stable liquid formulation of low viscosity, which can easily be measured and dosed and can be applied using automatic dispensing systems.

The aqueous solution is storage-stable for more than one year in closed containers at 20° C.; it solidifies at temperatures below freezing, but is usable again without loss of effectiveness after heating to room temperature.

The solution is stable to hard water and to alkali, acids and electrolytes in the amounts normally encountered in textile processing.

The adjuvant composition according to the invention may comprise, in addition to components (a), (b) and (c), further customary additives such as dispersants, wetting agents, levelling agents and antifoams.

The adjuvant composition according to the invention can be applied to the textile material in a pre-treatment process prior to the dyeing process or, preferably, it is applied in the same liquor as the dyes and, optionally, further additives.

Unlike other customary shade enhancers, the adjuvant according to the invention does not cause precipitation of dye particles.

The present invention relates also to a process for dyeing blends of polyamide and elastane fibres which comprises treating said fibres with an aqueous liquor containing an adjuvant composition according to the invention and at least one dye.

Dyeing is carried out preferably using reactive dyes, metal complex dyes or acid dyes, as described, for example, in Colour Index, 3rd edition (1971), being suitable.

The dyes used in the dyeing of the fibre material may comprise further additives, e.g. sodium chloride or dextrin.

PA/EL blends are frequently applied in form of elastic knits for lingerie, swim- and sportswear and high value athletic apparel.

The textile material can be used in any form, e.g. in the form of fibres, yarn, woven fabric or knitted fabric.

The treatment of the fibre material with the adjuvant compositions according to the invention is preferably carried out in accordance with the exhaust process, in which case the liquor ratio can be selected from within a wide range and is, for example, from 1:3 to 1:100, preferably from 1:4 to 1:50 and especially from 1:5 to 1:20.

Generally, good results are obtained when the adjuvant compositions according to the invention are used in amounts of from 0.1 to 20 g/liter, preferably from 0.2 to 10 g/liter.

Special apparatus is not required. For example, customary dyeing apparatus, e.g. open baths, winch becks, jigs, or paddle, jet or circulation apparatus, may be used.

The procedure is advantageously carried out at a temperature of, for example, from 20 to 130° C., preferably from 50 to 120° C. and especially from 60 to 100° C. The treatment time may be, for example, from 10 to 90 minutes and preferably from 15 to 60 minutes.

A preferred embodiment of the invention comprises a method of dyeing PA/EL blends fibres, wherein the undyed textile fibre material is brought into contact with an aqueous exhaust liquor comprising a composition according to claim 1 at from 40 to 60° C. The dye and, optionally, further additives are added and the temperature is then raised to from 90 to 150° C., preferably from 95 to 105° C. After a processing time of 20 to 80 min the liquor is slowly cooled down, rinsed with water, dried and, if necessary, subjected to an aftertreatment and a post-setting step.

The liquor can comprise, in addition to the adjuvant according to the invention and the dye, further customary additives, such as electrolytes, e.g. sodium chloride or sodium sulfate, dispersants, wetting agents and antifoams Dyeing of the fibre material can be carried out in accordance with customary dyeing or printing methods, for example in accordance with the padding or exhaust process. The dyeing liquors or printing pastes may comprise, in addition to water and the dyes, further additives, for example wetting agents, antifoams, levelling agents or agents that influence the characteristics of the textile material, for example softeners, flame-retardants, or dirt-, water- and oil-repellents, and also water-softeners and natural or synthetic thickeners, for example alginates and cellulose ethers.

The amounts in which dyes are used in the dye baths can vary within wide limits depending on the required depth of shade; in general, amounts of from 0.01 to 15% by weight, especially from 0.01 to 10% by weight, based on the material to be dyed, have proved to be advantageous.

Dyeing with reactive dyes, metal complex dyes or acid dyes is preferably carried out at a pH of from 3 to 8 and especially from 4 to 7. The liquor ratio can be selected from within a wide range, for example from 1:3 to 1:50, preferably from 1:5 to 1:30. Dyeing is preferably carried out at from 50 to 130° C. and especially from 80 to 120° C.

Following the method according to the invention there are dyeings obtained on PA/EL blends which are distinguished by a high degree of levelness and good fastness properties, in particular excellent wash and wet fastness.

A deep intensive build up of black dyes on EL is achieved without any loss of wet fastness, when reactive dyes, metal complex dyes or acid dyes are applied following the method according to the invention. This allows the production of garments with extreme contrast colours (e.g. black/white).

The dyeings have high stability to heat setting.

No change of shade or loss of wet fastness is observed, for example, during the moulding of lingerie garments.

The simultaneous application of shade enhancer and dyes means a substantial process simplification in connection with increased process safety and savings of time, water and energy.

The following Examples illustrate the invention in more detail.

Auxiliary A is an aqueous solution containing 10.5% by weight of cocamidopropyl betaine, 5.6% by weight of dodecyl dimethyl benzyl ammonium chloride, 5.25% by weight of ethoxylated oleyl alcohol containing on average 65 ethylene oxide units per molecule and 0.11% by weight of sodium hydroxide.

EXAMPLE 1

A 10 g piece of a polyamide/elastane (70:30) tricot is treated by exhaust process with a liquor containing 0 (comparison), 1%, 2% or 3% by weight, respectively, of Auxiliary A at 50° C. After 20 minutes 0.5 g/l Albaflow® CIR (fatty alcohol ethoxylate, penetration accelerant, supplied by Huntsman), 1.0 g/l Albafluid® E (lubricant, supplied by Huntsman), 0.5 g/l Univadine ER (levelling agent, supplied by Huntsman) and 1.0 g/l Albatex PS-35 (levelling agent, supplied by Huntsman) as well as 0.8% by weight of C. I. Acid Yellow 220, 0.6% by weight of Lanaset® Red PA 200% (metal complex dye, supplied by Huntsman) and 3.0% by weight of C. I. Acid Black 172 are added and the temperature is raised to 98° C. within 40 min. The liquor ratio is 10:1. The PA/EL tricot is dyed at 98° C. for 60 min, rinsed twice in a water bath for 10 minutes at 60° C., and finally the product is treated in a rinsing bath containing 2 g/l of Albatex® DS (levelling agent, supplied by Huntsman) at 60° C. for 20 min, rinsed once more in a water bath for 10 minutes at 60° C. and dried.

The fastness to water (severe) is determined according to AATCC 61 2A by evaluation of the bleeding effect, i.e. the degree of colouration of non-coloured fabrics concurrently present in the bath during the washing process. The results are summarized in Table 1:

TABLE 1

Fastness to water (severe) according to AATCC 61 2A

| Auxiliary A | CA | CO | PA | PES | PAC | WO |
|---|---|---|---|---|---|---|
| 0 (comparison) | 3-4 | 3-4 | 1-2 | 3-4 | 3-4 | 3 |
| 1% | 4 | 4 | 2 | 4 | 4 | 3 |
| 2% | 4 | 4 | 2 | 4 | 4 | 3 |
| 3% | 4-5 | 4-5 | 2-3 | 4-5 | 4-5 | 3-4 |

CA: cellulose acetate
CO: cotton
PA: polyamide
PES: polyester
PAC: polyacrylonitrile
WO: wool

EXAMPLE 2

A 10 g piece of a polyamide/elastane lace (90:10) is treated by exhaust process with a liquor containing 1% by weight of Auxiliary A at 50° C. After 20 minutes 0.11% by weight of C. I. Direct Yellow 6 and 1.5% by weight of C. I. Acid Black 172 as well as 1.0 g/l Univadine ER (levelling agent, supplied by Huntsman) are added and the temperature is raised to 98° C. within 40 min. The liquor ratio is 10:1. No precipitation is observed in the dye bath. The PA/EL lace is dyed at 98° C. for 60 min, rinsed twice in a water bath for 10 minutes at 60° C., dried and post-set 180° C. for 25 s. The dyeing so obtained shows very good on-tone effect on elastane fibers.

What is claimed is:

1. A process for dyeing blends of elastane and natural or synthetic polyamide or cellulose fibres which comprises treating said fibres with an aqueous liquor consisting of (a) a betaine of formula (1)

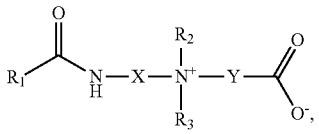

wherein $R_1$ is a monovalent radical of an aliphatic $C_4$-$C_{30}$ hydrocarbon, $R_2$ and $R_3$ independently of one another represent $C_1$-$C_{12}$ alkyl and X and Y independently of one another denote a bivalent radical of an aliphatic $C_1$-$C_{12}$ hydrocarbon, (b) a quaternary ammonium salt of formula (2)

(2)

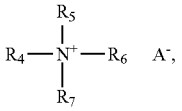

wherein $R_4$ is a monovalent radical of an aliphatic $C_4$-$C_{30}$ hydrocarbon, $R_5$, $R_6$ and $R_7$ independently of one another represent $C_1$-$C_{12}$ alkyl, $C_5$-$C_{24}$ aryl or $C_6$-$C_{30}$ aralkyl, $A^-$ is halogenide, nitrate, hydrogensulfate or sulfonate, and (c) an alkoxylated fatty alcohol, and (d) at least one dye and optionally one or more additives selected from a alkali, lubricant, electrolyte, antifoam, flame retardant, dirt-repellent, water-repellent, oil-repellent, alginate and water, and wherein the process is carried out in accordance with a padding or exhaust process.

2. A process according to claim 1 for dyeing blends of elastane and synthetic polyamide.

3. A process according to claim 1 for dyeing blends of elastane and cotton.

4. A process according to claim 1, wherein the dye is a reactive dye, a metal complex dye or an acid dye.

* * * * *